US009726370B2

(12) United States Patent
Hiraga

(10) Patent No.: US 9,726,370 B2
(45) Date of Patent: Aug. 8, 2017

(54) TUBULAR BURNER

(71) Applicant: Rinnai Corporation, Nagoya-shi, Aichi (JP)

(72) Inventor: Tadayuki Hiraga, Nagoya (JP)

(73) Assignee: RINNAI CORPORATION, Nagoya-shi (JP)

( * ) Notice: Subject to any disclaimer, the term of this patent is extended or adjusted under 35 U.S.C. 154(b) by 378 days.

(21) Appl. No.: 14/516,166

(22) Filed: Oct. 16, 2014

(65) Prior Publication Data

US 2016/0109119 A1 Apr. 21, 2016

(51) Int. Cl.

| | |
|---|---|
| ***F23D 14/02*** | (2006.01) |
| ***F23D 14/62*** | (2006.01) |
| ***F23D 14/14*** | (2006.01) |
| ***F23D 14/58*** | (2006.01) |

(52) U.S. Cl.

CPC ..... *F23D 14/02* (2013.01); *F23D 14/14* (2013.01); *F23D 14/583* (2013.01); *F23D 14/62* (2013.01); *F23D 2203/002* (2013.01)

(58) Field of Classification Search

CPC ..... F23D 14/02; F23D 14/62; F23D 14/583; F23D 14/14; F23D 2203/002

See application file for complete search history.

(56) References Cited

U.S. PATENT DOCUMENTS

| | | | |
|---|---|---|---|
| 2,121,948 A | 6/1938 | Borland | |
| 5,186,620 A | 2/1993 | Hollingshead | |
| 2007/0082309 A1 | 4/2007 | Zia et al. | |
| 2015/0184848 A1* | 7/2015 | Hiraga | F23D 14/583 431/354 |

FOREIGN PATENT DOCUMENTS

| | | |
|---|---|---|
| JP | 51-119023 U | 9/1976 |
| JP | 2012-037109 A | 2/2012 |
| JP | 2012-037110 A | 2/2012 |
| JP | 2012-042083 A | 3/2012 |

OTHER PUBLICATIONS

Office Action dated May 10, 2016, issued in counterpart Japanese Patent Application No. 2013-180893, with English translation. (6 pages).

* cited by examiner

*Primary Examiner* — Alfred Basichas

(74) *Attorney, Agent, or Firm* — Westerman, Hattori, Daniels & Adrian, LLP

(57) ABSTRACT

A tubular burner includes: a mixing tube having an inlet port into which a fuel gas and primary air flow; and a flame hole member having a plurality of flame holes and being fitted into a front end portion of the mixing tube. The flame holes of the flame hole member are made up of a central main flame hole and a plurality of subsidiary flame holes positioned around, and each being smaller than, the central main flame hole. In an annular region of the flame hole member defined between an outer periphery of the flame hole member and the central main flame hole, a plurality of non-flame-hole regions which are free from formation of the subsidiary flame holes are provided at a circumferential distance from one another. The plurality of the subsidiary flame holes are formed in each of flame hole regions defined between the non-flame-hole regions.

4 Claims, 2 Drawing Sheets

TUBULAR BURNER

BACKGROUND OF THE INVENTION

1. Technical Field

The present invention relates to a tubular burner including: a mixing tube having at a rear end thereof an inlet port into which a fuel gas and primary air flow; and a flame hole member having a plurality of flame holes and being fitted into a front end portion of the mixing tube so that a mixture of a fuel gas and primary air (hereinafter also referred to as "air-fuel mixture") is ejected from the flame holes for combustion.

2. Background Art

As this kind of tubular burner, there is known one in which are formed, as flame holes, a central main flame hole and a plurality of subsidiary flame holes which are smaller than the central flame hole and are positioned therearound (see, for example, US-A1-5186620, US-A1-20070082309, JP-2012-37109 A, JP-2012-37110 A, and JP-2012-42083 A). The reason for forming the subsidiary flame holes is to stabilize the combustion.

Conventionally, the subsidiary flame holes are evenly disposed over the entire circumference of the central main flame hole. Therefore, the secondary air to be supplied from outside the flame hole member is consumed for the combustion of the air-fuel mixture to be ejected from the subsidiary flame holes. As a result, the secondary air ceases to be sufficiently supplied to the root portion of the main flame that is formed by the combustion of the air-fuel mixture to be ejected out of the central main flame hole. The main flame will then be largely elongated forward to catch the secondary air, and the combustion apparatus provided with the tubular burner will become larger in size.

SUMMARY

Problems that the Invention is to Solve

In view of the above points, this invention has a problem of providing a tubular burner in which the secondary air is sufficiently supplied to the root portion of the main flame so that the main flame is prevented from largely elongating forward.

Means for Solving the Problems

In order to solve the above problem, this invention is a tubular burner comprising: a mixing tube having at a rear end thereof an inlet port into which a fuel gas and primary air flow; and a flame hole member having a plurality of flame holes and being fitted into a front end portion of the mixing tube so that an air-fuel mixture is ejected from the flame holes for combustion. The flame holes of the flame hole member are made up of a central main flame hole and a plurality of subsidiary flame holes positioned around, and each being smaller than, the central main flame hole. In an annular region of the flame hole member defined between an outer periphery of the flame hole member and the central main flame hole, a plurality of non-flame-hole regions which are free from formation (i.e., which have no formation) of the subsidiary flame holes are provided at a circumferential distance from one another, and the plurality of the subsidiary flame holes are formed in each of flame hole regions defined between the non-flame-hole regions.

According to this invention, the secondary air flows from outside the flame hole member to the central main flame hole through the non-flame-hole regions without being consumed for combustion of the air-fuel mixture to be ejected out of the subsidiary flame holes. Therefore, sufficient secondary air is supplied to the root portion of the main flame that is formed by the combustion of the air-fuel mixture ejected from the central main flame hole. The main flame can thus be prevented from largely elongating forward.

In this invention, preferably, the plurality of non-flame-hole regions are provided at a circumferentially equal distance from one another. According to this arrangement, the positions at which the secondary air is supplied to the main flame will be distributed at an equal distance. As a result, the central main flame hole can be prevented from deviating from the center line of the main flame in any of the directions.

By the way, in order to fix in position the flame hole member to the front end portion of the mixing tube, it is conceivable: to provide at a front end of the mixing tube a cylindrically projected portion projecting forward beyond a front surface of the flame hole member; and to form dented portions each of which is formed in a plurality of circumferential positions so as to dent diametrically inward such that the flame hole member is prevented from being pulled forward out of position. According to this invention, it is preferable to arrange the position of forming the dented portion at such a circumferential position as to coincide with each of the non-flame-hole regions. According to this arrangement, even if the cylindrically projected portion is provided, the secondary air becomes easier to flow into the non-flame-hole regions through the dented portions. As a result, there will be no shortage of supply of the secondary air to the main flame. In addition, the dented portions become farther away from the subsidiary flame holes. Overheating of the dented portions can thus be effectively prevented.

Further, in this invention, preferably, among the subsidiary flame holes formed in each of the flame hole regions, adjoining subsidiary flame holes are out of congruence in shape with each other. According to this arrangement, the frequencies of vibrations of the flames to be formed by the combustion of the air-fuel mixture ejected through the adjoining subsidiary flame holes are made to be different from each other, whereby the generation of the combustion resonance sounds can be restricted.

DESCRIPTION OF PREFERRED EMBODIMENTS

Figure 1:
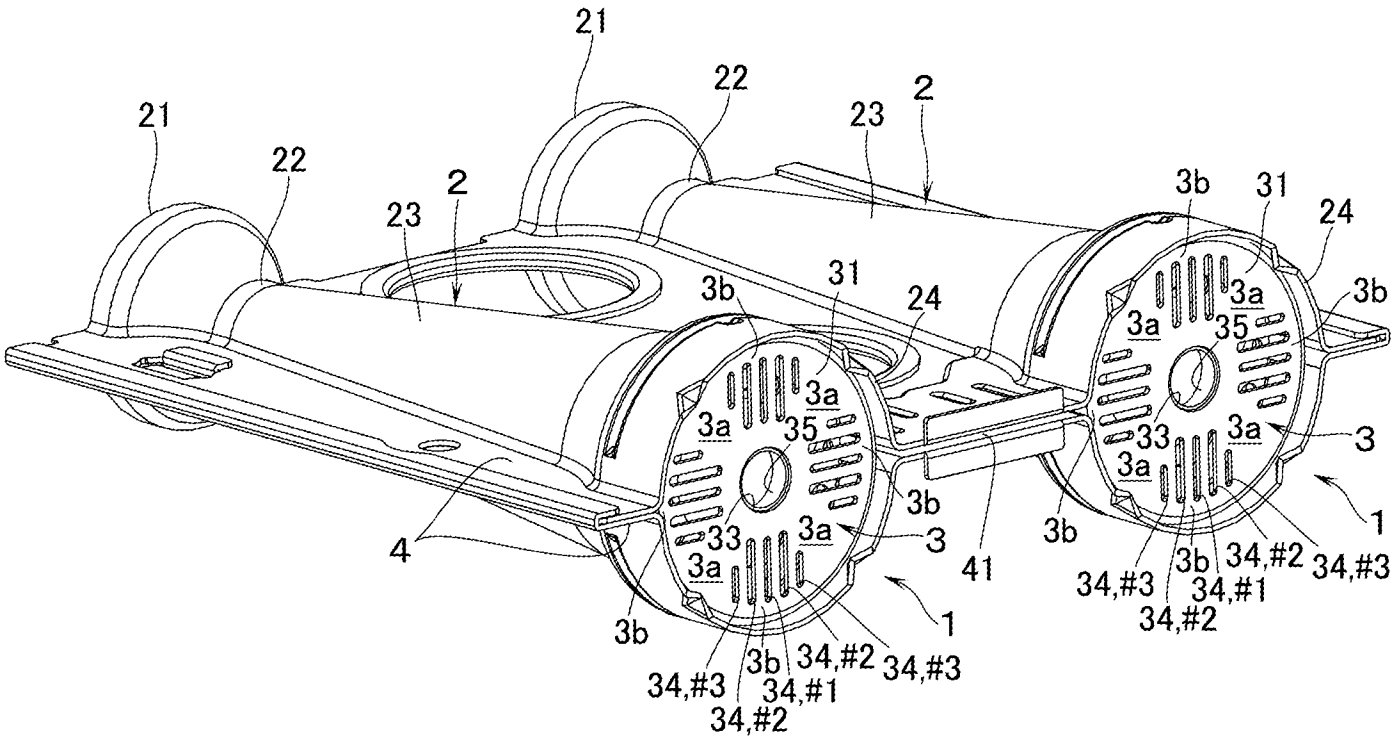
FIG. 1 is a perspective view of a tubular burner according to an embodiment of this invention.
Figure 2:
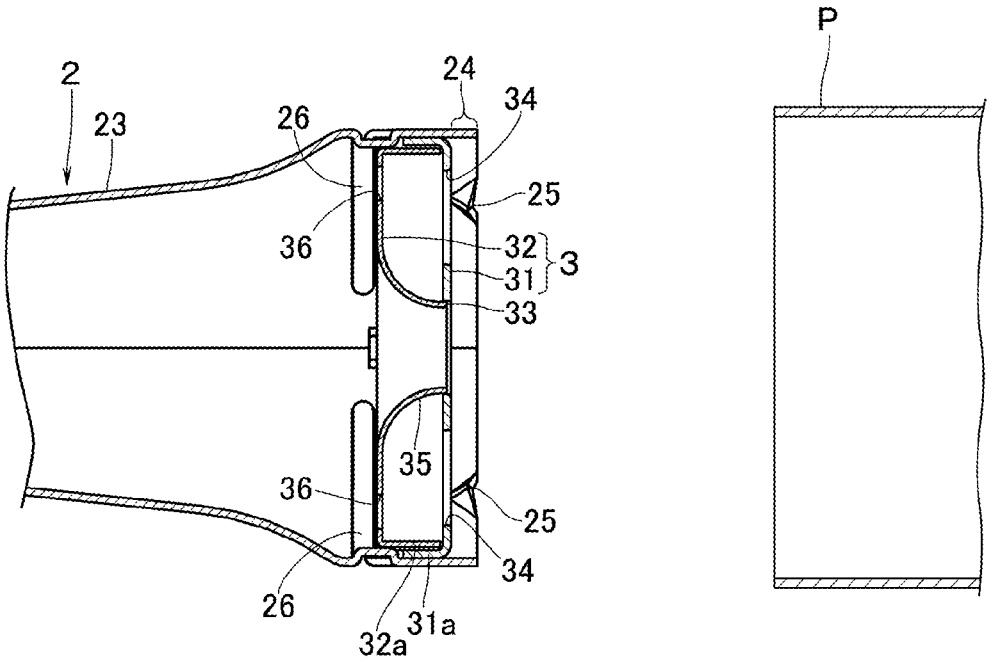
FIG. 2 is a sectional view of an essential portion of the tubular burner according to an embodiment of this invention.

In FIGS. 1 and 2 reference numeral 1 denotes a tubular burner according to an embodiment of this invention. This tubular burner 1 which is intended for use in a space heater is placed opposite to an inlet of a heat exchange pipe P which carries out heat exchange with the room air.

The tubular burner 1 is made up of a mixing tube 2, and a flame hole member 3 which is fitted into a front end portion of the mixing tube 2. The mixing tube 2 has an inlet port 21 at a rear end thereof, a venture section 22 which has a reduced diameter as compared with the inlet port 21, and a tube section 23 which gradually enlarges in diameter from the venture section 22 forward. It is thus so arranged that the fuel gas to be ejected out of a gas nozzle (not illustrated) that is disposed to lie opposite to the inlet port 21 and primary air flow from the inlet port 21 into the mixing tube 2 so that an air-fuel mixture of the fuel gas and the primary air is generated inside the mixing tube 2.

Further, according to this embodiment, two sets of the tubular burners 1, 1 are disposed in parallel with each other. The two mixing tubes 2, 2 of the two tubular burners 1, 1 are made up by joining upper and lower, i.e., two, plate members 4, 4 in which two half-divided mixing tubes 2 are formed with a lateral distance from each other. At a front end portion of a section which is positioned between both the mixing tubes 2, 2 of both the plate members 4, 4, there are formed dents which are dented in a direction in which both the plate members 4, 4 are placed away from each other. These dents constitute a carryover flame hole 41 which carries over the flame between both the tubular burners 1, 1.

The flame hole member 3 is made up of two plate members of a front plate 31 and a rear plate 32. The front plate 31 has a cylindrical section 31*a* which is elongated backwards from an outer periphery of a disc-shaped front section so as to be fitted into an inside of the front end portion of the mixing tube 2. Further, the rear plate 32 has a cylindrical section 32*a* which is elongated forward from an outer periphery of a disc-shaped rear section so as to be inserted into an inside of the cylindrical section 31*a* of the front plate 31.

In addition, at the front end of the mixing tube 2 there is provided a cylindrically projected portion 24 which projects forward beyond the front surface of the flame hole member 3. At a plurality of circumferential portions of this cylindrically projected portion 24, there are formed dented portions 25 which are dented diametrically inward so as to prevent the flame hole member 3, i.e., the front plate 31, from being pulled forward out of position. In addition, at the front end portion of the mixing tube 2 there are formed grooves 26 which are recessed diametrically inward so as to come into contact with the rear plate 32. It is thus so arranged that the front plate 31 and the rear plate 32 are sandwiched between the dented portions 25 and the grooves 26 so as to be fixed in position.

The front plate 31 has formed therein a central main flame hole 33 which is positioned in the front central portion of the front plate 31, and a plurality of subsidiary flame holes 34 which are positioned around the central main flame hole 33 and which are smaller than the central main flame hole 33. The rear plate 32 has formed therein a cylindrical part 35 in the central portion of the rear plate 32 in a manner to be elongated toward the central main flame hole 33, and a plurality of ventilation holes 36 which are positioned around the cylindrical part 35. The air-fuel mixture introduced into the central main flame hole 33 through the cylindrical part 35 is forcibly ejected forward out of the central main flame hole 33. As a result of combustion of this ejected air-fuel mixture, there will be formed a main flame elongated inside the heat exchange pipe P. On the other hand, the flow velocity of the air-fuel mixture to be ejected out of the subsidiary flame holes 34 through the ventilation holes 36 is kept relatively low, thereby contributing to the stabilized combustion. Further, the inner circumference and thereabout of the cylindrically projected portion 24 becomes negative in pressure. As a result, the air-fuel mixture to be ejected out of the radially outermost end portions of the subsidiary flame holes 34 will be re-circulated in a manner to swirl in the neighborhood of the inner circumference of the cylindrically projected portion 24. There will thus be formed in this part a flame that is hard to be lifted off, thereby securing flame stability.

By the way, in case the subsidiary flame holes 34 are uniformly distributed over the entire circumference of the central main flame hole 33, the secondary air that is supplied from the outside of the flame hole member 3 will be consumed in the combustion of the air-fuel mixture to be ejected out of the subsidiary flame holes 34. As a result, sufficient amount of secondary air will no longer be supplied to the root portion of the main flame, and the main flame will largely be elongated forward to catch the secondary air. In such a case, it becomes necessary to extend the heat exchange pipe P, resulting in an increase in size of the space heater.

As a solution, according to the embodiment of this invention, in an annular region defined between an outer periphery of the front plate 31 which constitutes the flame hole member 3 and the central main flame hole 33, a plurality of (four in this embodiment) non-flame-hole regions 3*a* which are free from formation of subsidiary flame holes 34 are provided at a circumferentially equal distance from one another. A plurality of subsidiary flame holes 34 are thus formed in each of flame hole regions 3*b* defined between the non-flame-hole regions 3*a*. Further, the dented portions 25 for preventing the flame hole member 3 from being pulled forward out of position are formed at such a circumferential position as to coincide with each of the non-flame-hole regions 3*a*.

According to the above-described arrangement, the secondary air from the outside of the flame hole member 3 to the central main flame hole 33 flows through the non-flame-hole regions 3*a* without being consumed for the combustion of the air-fuel mixture to be ejected out of the subsidiary flame holes 34. Therefore, the secondary air is sufficiently supplied to the root portion of the main flame, thereby preventing the main flame from largely elongating forward. Still furthermore, since the plurality of non-flame-hole regions 3*a* are provided at circumferentially equal distance from one another, the positions at which the secondary air is supplied to the main flame are distributed at an equal distance from one another. The main flame can thus be prevented from getting deviated to any direction off from the center line of the central main flame hole 33.

In addition, even if the cylindrically projected portion 24 is provided at the front end of the mixing tube 2 in a manner to project forward beyond the front surface of the flame hole member 3, it becomes easier for the secondary air to flow into the non-flame-hole regions 3*a* through the dented portions 25. As a result, the shortage of supply of the secondary air to the main flame will not occur. Still furthermore, the dented portions 25 become farther away from the subsidiary flame holes 34. The overheating of the dented portion 25 that would otherwise be more likely to be heated due to denting in the diametrically inward direction, can effectively be prevented.

Figure 3:
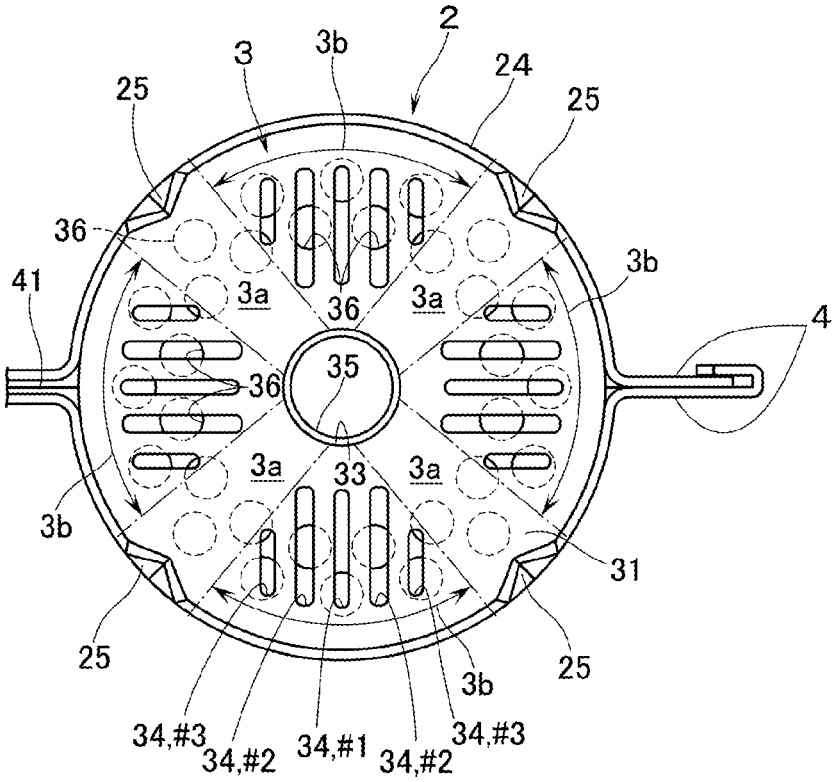
FIG. 3 is a front view of the tubular burner according to an embodiment of this invention.

Further, in this embodiment the subsidiary flame holes are arranged as follows. In other words, in each of the flame hole regions 3*b* there are formed a total of five subsidiary flame holes made up of: a slit shaped #1 subsidiary flame hole 34 that is diametrically elongated in the circumferentially center of each of the flame hole regions 3*b*; a pair of slit shaped #2 subsidiary flame holes 34 that are parallelly disposed on both sides of the #1 subsidiary flame hole 34; and slit shaped #3 subsidiary flame holes 34 that are parallelly disposed on circumferentially outer sides of each of the #2 subsidiary flame holes 34. As shown in FIG. 3, among the subsidiary flame holes 34 that are formed in each of the flame hole regions 3*b*, the shapes of the adjoining subsidiary flame holes 34 are arranged to be out of congruence with each other. Specifically, the width of the #2 subsidiary flame hole 34 is made larger than the width of the #1 subsidiary flame hole 34. The shape of the #1 subsidiary flame hole 34 is made to be out of congruence in shape with the adjoining #2 subsidiary flame hole 34. The length and the width of the #3 subsidiary flame hole 34 are made smaller than the length and width of the #2 subsidiary flame hole 34 so that the adjoining #2 subsidiary flame hole 34 and the #3 subsidiary flame hole 34 are out of congruence in shape with each other. According to this arrangement, the frequencies of vibrations of the flames to be formed by the combustion of the air-fuel mixture ejected through the adjoining subsidiary flame holes 34 are made to be different from each other to thereby restrict the generation of the combustion resonance sounds.

Description has so far been made of the embodiment of this invention with reference to the accompanying drawings. This invention shall, however, not be limited to the above. For example, the subsidiary flame holes 34 need not be made into slit shape as in the above-described embodiment, but may be formed into round hole shape. Further, in the above-described embodiment, the flame hole member 3 is made into a two-plate construction made up of the front plate 31 and the rear plate 32. It is also possible to make the flame hole member 3 into a single plate construction made up of a thick plate such as of ceramics, and the like. Furthermore, in the above-described embodiment this invention was intended for application to the tubular burner for use with a space heater, but this invention may be applied to a tubular burner which is used in a combustion apparatus other than a space heater.

What is claimed is:

1. A tubular burner comprising: a mixing tube having at a rear end thereof an inlet port into which a fuel gas and primary air flow; and a flame hole member having a plurality of flame holes and being fitted into a front end portion of the mixing tube so that an air-fuel mixture is ejected from the flame holes for combustion, the flame holes of the flame hole member being made up of a central main flame hole and a plurality of subsidiary flame holes positioned around, and each being smaller than, the central main flame hole, wherein, in an annular region of the flame hole member defined between an outer periphery of the flame hole member and the central main flame hole, a plurality of non-flame-hole regions which are free from formation of the subsidiary flame holes are provided at a circumferential distance from one another, and wherein the plurality of the subsidiary flame holes are formed in each of flame hole regions defined between the non-flame-hole regions, and wherein the mixing tube further has: at a front end thereof a cylindrically projected portion projecting forward beyond a front surface of the flame hole member; and a dented portion which is formed in the cylindrically projected portion to dent diametrically inward at such a circumferential position as to coincide with each of the non-flame-hole regions such that the flame hole member is prevented from being pulled forward out of position.

2. The tubular burner according to claim 1, wherein, among the subsidiary flame holes formed in each of the flame hole regions, adjoining subsidiary flame holes are out of congruence in shape with each other.

3. The tubular burner according to claim 1, wherein the plurality of non-flame-hole regions are provided at a circumferentially equal distance from one another.

4. The tubular burner according to claim 3, wherein, among the subsidiary flame holes formed in each of the flame hole regions, adjoining subsidiary flame holes are out of congruence in shape with each other.

* * * * *